United States Patent [19]

Guillot

[11] 4,211,073

[45] Jul. 8, 1980

[54] COMBUSTION CHAMBER PRINCIPALLY FOR A GAS TURBINE

[75] Inventor: Jack Guillot, Juvisy sur Orge, France

[73] Assignee: Guidas, Loire, France

[21] Appl. No.: 881,538

[22] Filed: Feb. 27, 1978

[30] Foreign Application Priority Data

Feb. 25, 1977 [FR] France ..... 77 06339

[51] Int. Cl.[2] ..... F02C 7/22

[52] U.S. Cl. ..... 60/746; 60/758; 60/760

[58] Field of Search ..... 60/39.65, 39.74 R, 39.36; 431/352, 353

[56] References Cited

U.S. PATENT DOCUMENTS

| | | | |
|---|---|---|---|
| 2,546,432 | 3/1951 | Darling | 60/39.65 |
| 2,882,681 | 4/1959 | Hudson et al. | 60/39.65 |
| 2,930,192 | 3/1960 | Johnson | 60/39.74 R |
| 3,306,333 | 2/1967 | Mock | 431/352 |
| 3,451,216 | 6/1969 | Harding | 60/39.65 |
| 3,520,134 | 7/1970 | Cripe et al. | 60/39.65 |
| 3,952,501 | 4/1976 | Saintsbury | 60/39.65 |

FOREIGN PATENT DOCUMENTS

| | | | |
|---|---|---|---|
| 661864 | 11/1951 | United Kingdom | 60/39.65 |

*Primary Examiner*—Robert E. Garrett

*Attorney, Agent, or Firm*—Remy J. VanOphem

[57] ABSTRACT

This invention concerns an improved combustion chamber comprising two concentric sheet metal cases forming a space into which air is admitted. The air passes from the space to the interior of the chamber in primary, secondary, annular, and tertiary air flows. The fuel coming from lateral nozzles forms a flame which is directed at first toward the closed end, then turned back by the secondary air flow. The external case comprises two walls between which a cooling flow circulates. The invention thereby achieves reduction in atmospheric pollution from exhaust gases.

8 Claims, 7 Drawing Figures

COMBUSTION CHAMBER PRINCIPALLY FOR A GAS TURBINE

BACKGROUND OF THE INVENTION

1. Field of the Invention

The present invention concerns an improved combustion chamber intended for fitting to a gas turbine.

2. Description of the Prior Art

A combustion chamber for a gas turbine is known, for example according to U.S. Pat. No. 3,650,106 in which air under pressure coming from a centrifugal compressor is admitted between two concentric chamber cases of sheet metal, toward the closed end of the two cases. A spray nozzle located in the center of the bottom of the chamber injects an atomized liquid fuel into the internal case where it is mixed with some air which penetrates inside this internal case through various perforations whereby combustion gases are turned back so as to circulate in the opposite direction in relation to the air and are driven to a high pressure wheel of the turbine.

A flame is developed along the length of the combustion chamber and it is difficult to situate the turbine with such a combustion chamber under the bonnet of a lorry where space is limited.

A combustion chamber is likewise known in which the flame is first of all directed towards the closed end to be turned around later. This arrangement allows a reduction in the length of the chamber, but in practice the metal components at the end of the chamber eventually melt and break due to, the high temperature there. Because of this, the temperature of the admitted air must not exceed about 200° C. This in turn prohibits the use of heat exchangers which allow recovery of part of the heat of the burned gases by heating the admitted (input) air, to about 580° C., for example. The output of the turbine is therefore limited and the exhaust gases contain unburned fuel which is a source of atmospheric pollution, in addition to the usual nitrogen oxides.

SUMMARY OF THE INVENTION

The invention is intended to achieve, among other things, an improved combustion chamber which limits pollution with exhaust gases, which avoids bulky length, and which improves the output of the turbine.

A combustion chamber according to the invention comprises two concentric sheet metal cases forming a space between them in which admitted air is directed towards the closed end of the chamber, and at least one spray nozzle which injects an atomized liquid fuel into the internal case which internal case is provided with openings for the passage of the admitted air. The nozzle or nozzles open into the lateral wall of the internal case at some distance from the closed end. The openings provided in the internal case for the passage of the admitted air are arranged so as to establish a primary flow of air which feeds the combustion process while directing the flame towards the closed end of the chamber and diverting this flame down near the wall of the internal case, and a secondary flow of air which issues from the center of the closed end of the chamber and feeds the combustion process while turning the flame around away from the closed end and up to the center of the chamber.

The combustion chamber can be fitted with several equidistant burners, the geometrical axes of which are located in the same transverse plane in relation to the main axis of the combustion chamber.

The internal case may comprise a dome and a tube which form between them an annular slot through which passes the primary flow of air, the tube having level with the slot, an annular deflector which sends down the primary flow of air towards the closed end.

The tube of the internal case may also have a series of openings which allow a tertiary flow of air to be established, penetrating into the internal case and mixing with the combustion gases to lower the temperature of these gases at the exit from the combustion chamber.

The dome of the internal case may also have a series of openings situated at the opposite side of the burners in relation to the annular slot, so as to establish a flow of air which clings against the wall of the dome while being directed towards the end of the chamber where this flow of air is mixed with the secondary air flow.

The external case may additionally consist of two walls forming a space between them in which a flow of cooling air circulates. This flow of air comes into the external case at a temperature lower than that of the flow of admitted air and emerges from the external case in the center of the combustion chamber so as to mix with the secondary flow of combustion air.

The annular slot of the internal case may be sufficiently large to establish a large output of primary flow of air which allows the use of simple spray nozzles with a straight jet to the flame.

The admitted air supplied to the combustion chamber may also come from a heat exchanger in which this admitted air is previously heated to about 580° C. by the exhaust gases. The different openings provided for the passage of the admitted air through the internal case may then be calibrated in such a way as to obtain a particularly high thermal radiation and temperature in the zone of deflection of the flame, which thus reduces the unburned fuel in the exhaust thereby reducing atmospheric pollution.

BRIEF DESCRIPTION OF THE DRAWINGS

The attached drawings, given as non-limiting examples, will allow the preferred embodiment of the invention to be better understood.

DESCRIPTION OF THE PREFERRED EMBODIMENT

Figure 1:
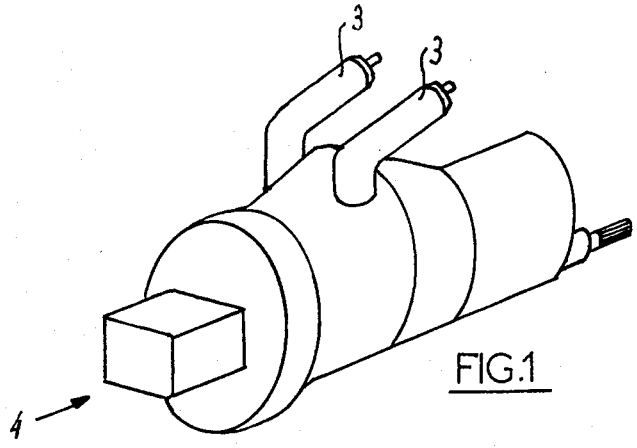
FIG. 1 is an overall diagrammatic view in perspective of a gas turbine fitted with two combustion chambers.
Figure 2:
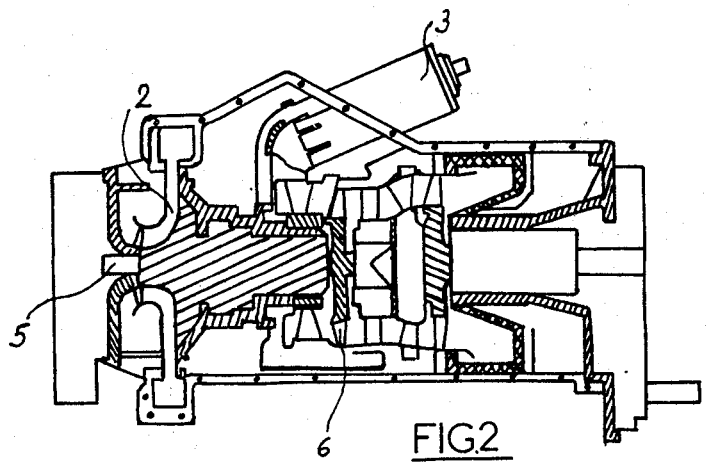
FIG. 2 is a view showing this same turbine in section on a vertical plane passing through the main axis of the turbine.
Figure 3:
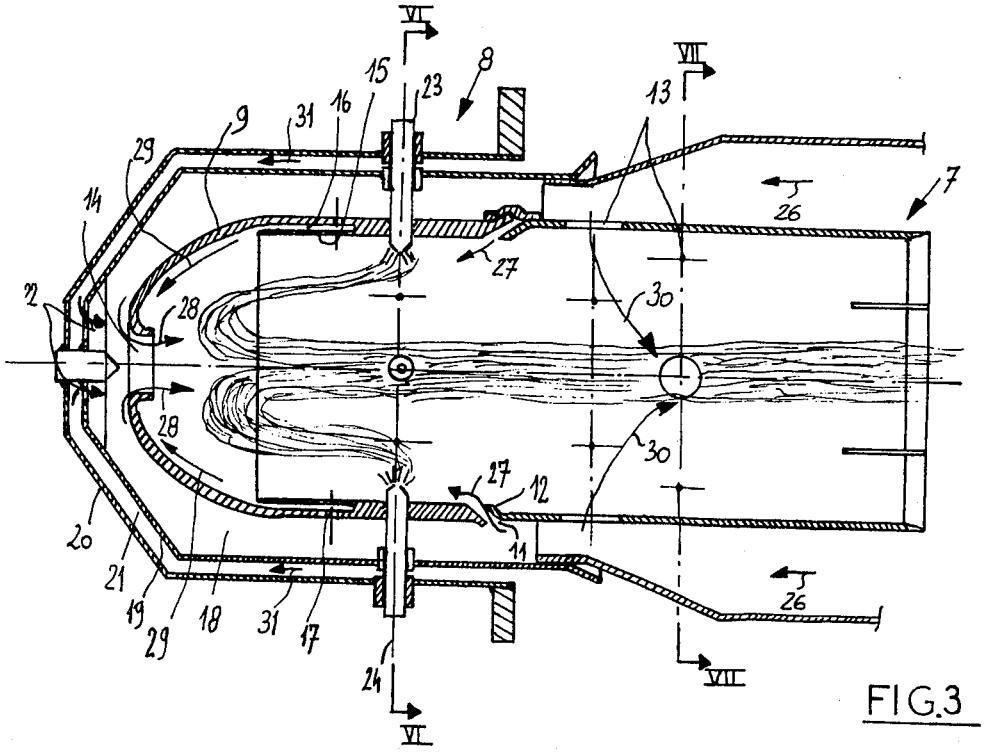
FIG. 3 is a view showing a combustion chamber according to the invention in section on a plane passing through the axis.
Figure 4:
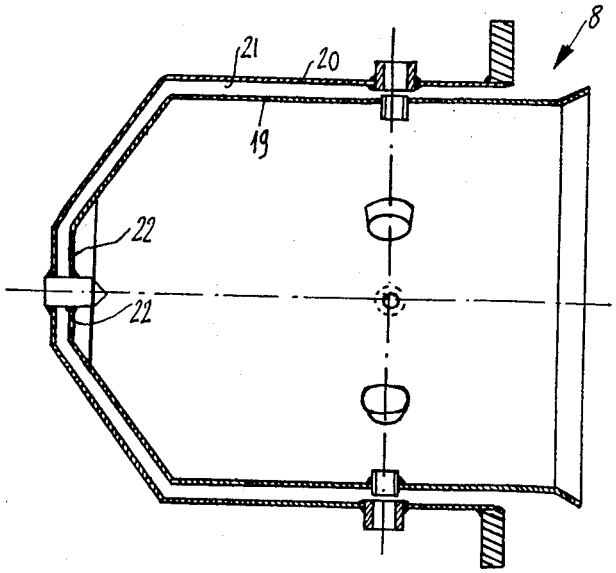
FIG. 4 is a view showing the external case of this chamber in section on a plane passing through the axis.

The gas turbine shown diagrammatically in FIGS. 1 and 2 is, essentially, identical to that described in the French Pat. No. 1 592 591. The turbine has a gas generator comprising a wheel 2 of a centrifugal compressor which blows the admitted air into two combustion chambers 3 mounted parallel side by side in the same transverse plane in relation to direction 4 defined by the shaft 5 of the turbine. The hot gases under pressure which come out of the chambers 3 cause the rotation of the high pressure wheel 6 of the turbine. Downstream of the wheel 6, the turbine can carry various known components, usually one or more distributors and a low pressure turbine wheel.

This invention concerns the detailed design of the combustion chambers, one embodiment being as shown in detail in FIGS. 3 to 7.

The combustion chamber comprises two concentric sheet metal cases, namely an internal case 7 and an external case 8. The internal case 7 comprises a dome 9 and a tube 10 which form between them an annular slot 11. The tube 10 carries at the level of the slot an annular deflector 12 as well as two series of openings 13 drilled around its wall near the slot 11. An opening 14 is provided in the center of the dome 9, the dome also having an internal cylindrical lip 15 opening in the direction of the closed end of the dome and forming an internal cylindrical space 16 against the lateral wall of the dome. A series of openings 17 allows space 16 to communicate with the space 18 which is formed between the cases 7 and 8.

The external case 8 is formed, level with the dome 9, by two walls 19 and 20 defining a space 21 between them. This space 21 communicates with the space 18 in the end of the dome by means of four holes 22 provided in the in wall 19.

Figure 6:
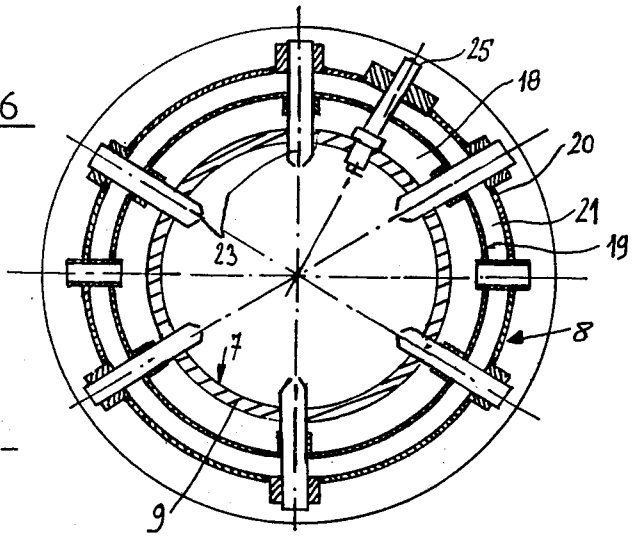
FIG. 6 is a section along VI—VI (FIG. 3).
Figure 7:
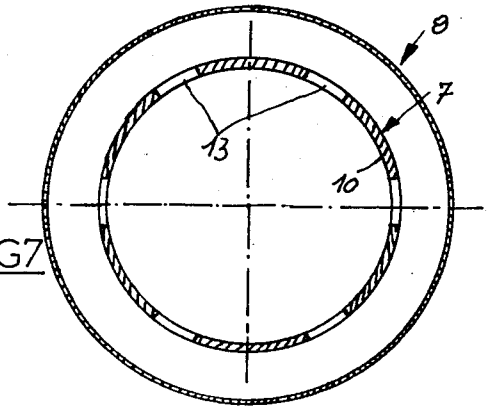
FIG. 7 is a section along VII—VII (FIG. 3).
Figure 5:
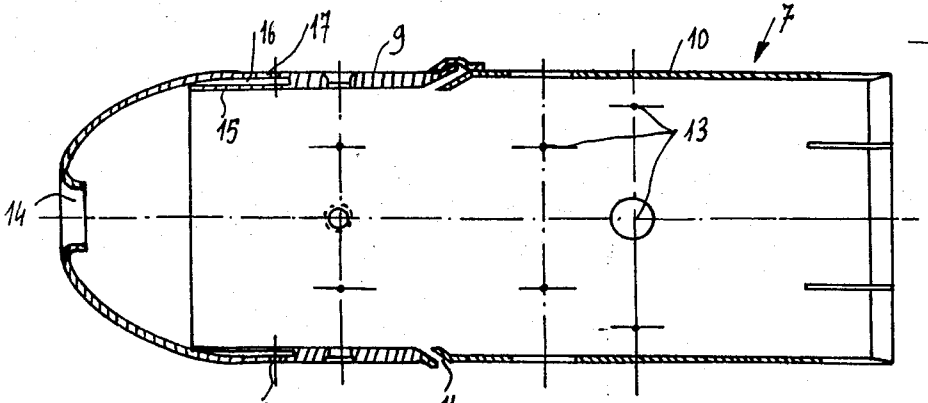
FIG. 5 is a view showing the internal case of this chamber in section on a plane passing through the axis.

The combustion chamber is fitted with six spray nozzles 23. These nozzles are equidistant and their geometrical axes are situated in the same plane 24 perpendicular to the axis of the combustion chamber. This plane 24 is situated between the lip 15 and the annular slot 11 so that each nozzle 23 successively passes through the walls 19 and 20 of the external case 8, and the dome 9 of the internal case 7. A spark plug 25, fitted in the same manner as the nozzles, and between an adjacent two of them, likewise has its axis located in the plane 24 as shown in FIG. 6.

Preferably, simple nozzles with a straight jet of known type are used.

OPERATION

The air coming from the wheel 2 of the centrifugal compressor circulates between the cases 7 and 8 in the direction of the closed end of the combustion chamber as indicated by the arrows 26. Part of this admitted air penetrates into the internal case 7 by passing through the annular slot 11 to form a primary flow of air (arrows 27). This primary air feeds the combustion of the liquid fuel which the nozzles 23 atomize into the internal case 7, this combustion being started owing to the spark plug 25. The annular deflector 12 directs the flow 27 towards the closed end of the combustion chamber, and the flow 27 is of sufficient force to turn the formed flame towards the closed end of the chamber, near the wall of the internal case 7.

Another part of the admitted air escapes from the space 18 to enter the combustion chamber through the opening 14 to constitute a secondary flow of air (arrows 28) which likewise feeds the combustion while turning the flame back away from the closed end and into the center of the chamber.

A small part of the admitted air escapes from the space 18 through the small openings 17 into the space 16, leaving it with an annular flow (arrows 29) which clings against the wall of the dome while being directed towards the closed end of the chamber where this flow 29 is mixed with the secondary flow of air 28. The flow 29 effectively protects the wall of the dome 9 from the flame.

Finally, another part of the admitted air escapes through the openings 13 to constitute a tertiary flow of air (arrows 30) which is mixed with the burned gases so as to cool them.

The admitted air supplied to the combustion chamber preferably comes from a heat exchanger in which this admitted air is previously heated to about 580° C. by the exhaust gases.

A flow of cooling air is sent into the space formed between the walls 19 and 20 of the external case 8 (arrows 31). This air is supplied to the combustion chamber at a temperature below 200° C. and it escapes from the space 21 through the holes 22.

Contrary to the known systems, there is therefore no metal component liable to melt in the zone in which the flame is turned back, where the thermal radiation and the temperature are otherwise particularly high. In this way, the losses due to unburned fuel are reduced and the output of the turbine proportionately increased, while atmospheric pollution is diminished. Thus, measurement has shown that, for a turbine of conventional construction, the combustion chambers according to the invention allow a reduction of 90% in the carbon monoxide (CO) content of the exhaust gases. Similarly the content of nitrogen oxides of the exhaust gases can be reduced by as much as 25%.

In addition, a further advantage inherent in the turning back of the flame lies in that there is less likelihood of the flame being extinguished since it is more compact. Furthermore, the flows may be established over large sections with a small air displacement speed, particularly the tertiary flow of air 30, in which the flow is at about 40 meters per second, and not 120 meters per second such as in aeronautical. The turbine therefore functions in a stable manner while running slowly.

It must likewise be noted that this combustion chamber is about half the length of the conventional chambers with a linear flame, which constitutes an appreciable advantage when the turbine must be situated under the bonnet of a lorry.

Having described my invention, it will be apparent to those skilled in the art to modify portions of the invention without departing from the spirit thereof. The examples given are not intended to limit the invention to those embodiments.

What I claim is:

1. A combustion chamber device wherein a source of air and fuel is combined with an ignition source for combustion, said device comprising:

an external case having a hollow wall defining a first air flow passage means, said passage means having an inlet and an outlet;

an internal case mounted concentric with and juxtaposed said external case, said internal and external case defining a second passage therebetween, said internal case further comprising:

an axial inlet passage and an outlet passage, said axial inlet passage and second passage defining a secondary air flow passage means communicating with said first passage means; and primary air flow passage means located in said internal case interposed said axial inlet passage and said outlet passage for establishing a primary air flow, said primary air flow passage means communicating with said second passage such that a primary air flow is provided from said second passage into said internal case, said primary air flow being directed towards said axial inlet passage;

means for injecting fuel into said internal case mounted to said internal and external case between said primary air flow passage means and said axial inlet passage;

means for igniting injected fuel mounted to said internal and external case proximate said means for injecting fuel, said igniting means communicating with said injecting fuel means and primary air flow to establish a combustion flame in said internal case, said primary air flow directing said combustion flame towards said axial inlet passage of the internal case, said primary air flow further diverting said flame down towards the center of said internal case and communicating with said secondary air flow through said axial inlet passage to further divert the direction of said combustion flame towards said outlet passage such that the flame forms a vortex along the axial center of said internal case and the burnt gases are diverted towards said outlet passage along said axial vortex; and means for cooling said internal case, said cooling means interposed said injecting fuel means and said axial inlet passage such that air flow from said second passage through said cooling means cools the walls of said internal case substantially between said injecting means and said axial inlet passage.

2. A combustion chamber according to claim 1 wherein, said internal concentric case further comprises:

a dome member;

a tube member located adjacent said dome member;

means for attaching said dome member to said tube member, and wherein, said primary passage means comprises an annular slot formed between said dome member and said tube member, said tube member further having a flange projecting inwardly from said inner wall of said internal concentric case near said annular slot, said annular slot cooperating with said flange to define a primary air flow passage such that the primary air flow is directed towards said axial inlet passage.

3. A combustion chamber according to claim 1 further comprising at least one burner of known type located in a plane transverse to the main axis of the internal case and projecting into said internal case.

4. A combustion chamber according to claim 1 further comprising a tertiary air flow passage means located in said internal case between said primary air flow passage means and said outlet passage of the internal case, said tertiary passage means comprises at least one opening in the internal case arranged so as to establish a tertiary flow of air, such that said tertiary air flow mixes with said combustion gases to thereby lower the temperature of said gases proximate said outlet passage of said internal case.

5. A combustion chamber according to claim 1 wherein, said internal case further comprises a plurality of orifices and an internal lip substantially parallel to said internal case, said internal lip forming a concentric groove between said internal case and said lip, said plurality of orifices being mounted in said internal case proximate said annular groove for communicating said second passage between said internal case and said external case with said annular groove by means of said plurality of orifices, such that said annular groove, and said second passage cooperate to create a flow of cooling air directed toward said axial inlet passage congruent said internal case to cool said internal case between said plurality of orifices and said axial inlet passage and thereafter mix with said secondary flow of air.

6. A combustion chamber according to claim 1 wherein, the external case further comprises an internal wall and an external wall forming therebetween said hollow wall and wherein said first air flow passage means further comprises a cooling flow of air, the temperature of the air of said cooling flow entering said hollow wall being at a lower temperature than the air entering said second passage between said internal concentric case and said external case, said internal wall of said external case having openings therein located at said outlet of said external case, thereby communicating said cooling flow of air with said second passage between said external case and said internal concentric case whereby cooling flow is mixed with said secondary air flow.

7. A combustion chamber according to claim 4 wherein, said at least one opening in said internal case is of a predetermined size such that said tertiary flow of air has a velocity of about 40 meters per second.

8. A combustion chamber according to claim 1 further comprising a heat exchanger communicating with said combustion gases to heat the air admitted into said second passage between said external case and said internal concentric case.

* * * * *

UNITED STATES PATENT OFFICE

CERTIFICATE OF CORRECTION

Patent No. 4,211,073 Dated July 8, 1980

Inventor(s) Jack Guillot

It is certified that error appears in the above-identified patent and that said Letters Patent are hereby corrected as shown below:

Column 1, line 65, after the word "up" delete the word "to".

Column 3, line 28, after the word "in" delete the words "the in".

Signed and Sealed this

*Sixteenth* Day of *December 1980*

[SEAL]

*Attest:*

SIDNEY A. DIAMOND

*Attesting Officer*

*Commissioner of Patents and Trademarks*